US008298057B2

(12) United States Patent
Huber

(10) Patent No.: US 8,298,057 B2
(45) Date of Patent: Oct. 30, 2012

(54) HOLLOW SPACE AERATING DEVICE

(75) Inventor: Maximilian Huber, Wiedergeltingen (DE)

(73) Assignee: Huber Kunststoff & Technik GmbH, Wiedergeltingen (DE)

( * ) Notice: Subject to any disclaimer, the term of this patent is extended or adjusted under 35 U.S.C. 154(b) by 1069 days.

(21) Appl. No.: 11/916,520

(22) PCT Filed: Jun. 6, 2006

(86) PCT No.: PCT/EP2006/005396

§ 371 (c)(1),
(2), (4) Date: Jun. 30, 2008

(87) PCT Pub. No.: WO2006/131319

PCT Pub. Date: Dec. 14, 2006

(65) Prior Publication Data

US 2009/0163133 A1 Jun. 25, 2009

(30) Foreign Application Priority Data

Jun. 4, 2005 (DE) ..... 20 2005 008 867 U

(51) Int. Cl.
*F24F 7/007* (2006.01)
*B60H 1/00* (2006.01)

(52) U.S. Cl. ..... 454/338; 454/119; 454/903

(58) Field of Classification Search ..... 454/338, 454/48, 63, 119, 903; 417/283
See application file for complete search history.

(56) References Cited

U.S. PATENT DOCUMENTS

| | | | | | |
|---|---|---|---|---|---|
| 2,487,689 | A | * | 11/1949 | Black | 126/80 |
| 3,543,325 | A | * | 12/1970 | Hamrick | 15/314 |
| 4,923,251 | A | * | 5/1990 | Funakawa et al. | 299/64 |
| 5,072,719 | A | * | 12/1991 | Burger et al. | 126/515 |
| 5,163,869 | A | | 11/1992 | Yeh et al. | |
| 5,380,245 | A | * | 1/1995 | Reiterman et al. | 454/63 |
| 5,702,493 | A | * | 12/1997 | Everetts et al. | 55/356 |
| 5,724,701 | A | * | 3/1998 | Jones | 15/304 |
| 5,868,558 | A | * | 2/1999 | Parker | 418/70 |
| 5,911,623 | A | * | 6/1999 | Trana et al. | 454/63 |
| 5,979,343 | A | * | 11/1999 | Gregor et al. | 111/175 |
| 6,393,724 | B1 | * | 5/2002 | Apple et al. | 34/232 |
| 6,402,613 | B1 | * | 6/2002 | Teagle | 454/195 |
| 6,607,573 | B1 | * | 8/2003 | Chaurushia et al. | 55/356 |
| 6,616,720 | B1 | * | 9/2003 | Smith | 55/385.2 |

(Continued)

FOREIGN PATENT DOCUMENTS

| | | |
|---|---|---|
| DE | 297 23 738 U1 | 1/1999 |
| WO | WO 2004/065858 A | 8/2004 |

*Primary Examiner* — Steven B McAllister
*Assistant Examiner* — Frances H Kamps
(74) *Attorney, Agent, or Firm* — Knobbe, Martens, Olson & Bear LLP

(57) ABSTRACT

The invention relates to a simple hollow space, in particular a channel, a cellar or a living room, aerating device (10) comprising several paddles (12) which are fixed to a hub (14) and surrounded by a fan housing (16) provided with input and output (17, 18) sides and a motor (20) which is mounted on the axis of rotation (15) of the hub (14) for driving the hub (14) and the paddles (12). According to said invention, a cover arrangement (30; 40) can be positioned on the output side (17) in such a way that a part thereof is covered, wherein said cover arrangement (30; 40) is provided with at least one opening (34-36; 44, 45) for connecting to a respective discharge hose (37-39; 47, 48).

9 Claims, 1 Drawing Sheet

Figure 1:
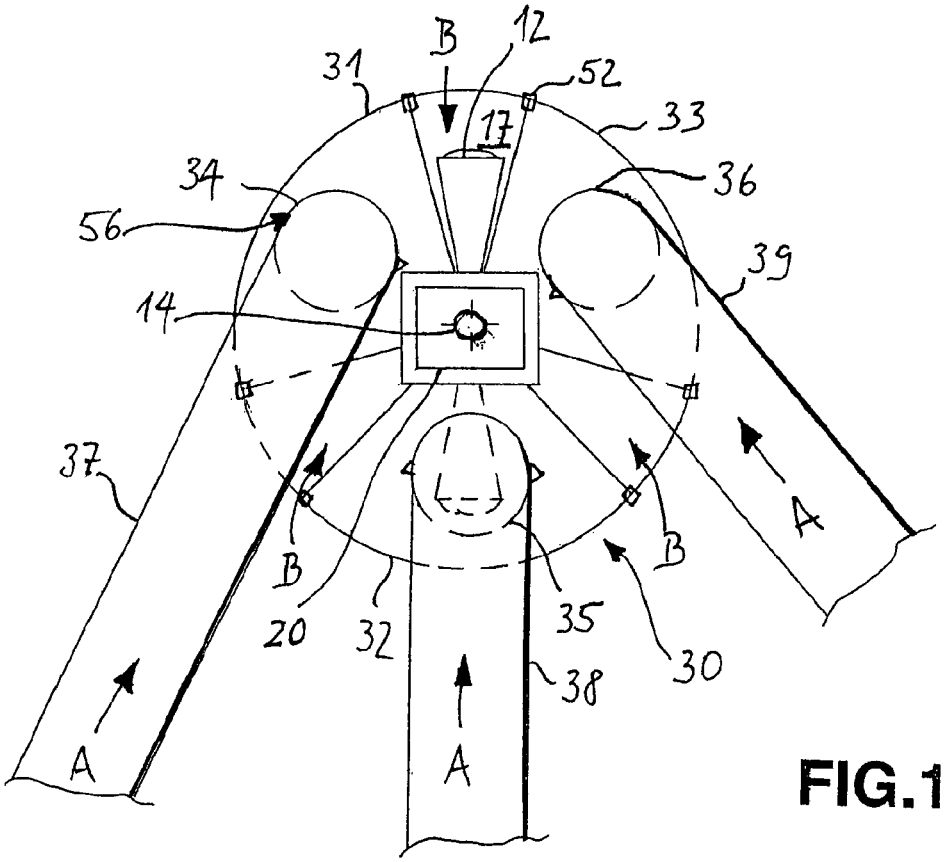

U.S. PATENT DOCUMENTS 6,632,134 B2 * 10/2003 DePonio ..... 454/342
6,834,412 B2 * 12/2004 Stanovich et al. ..... 15/327.2
6,884,159 B1 * 4/2005 Ferraud, Jr. ..... 454/119
7,004,688 B2 * 2/2006 Tasker ..... 406/39
7,011,578 B1 * 3/2006 Core ..... 454/292
7,550,022 B2 * 6/2009 Smith ..... 55/385.1
2003/0157882 A1 * 8/2003 Boulanger et al. ..... 454/256

* cited by examiner

HOLLOW SPACE AERATING DEVICE

The present invention relates to a device for venting a cavity, in particular a cellar or a dwelling-room, in accordance with the preamble of claim 1.

There are known large fans, with which air can be blown into a certain direction or else rather be led into a cavity. Such fans have fan blades fixed to a hub and surrounded by a fan housing which exhibits a suction side and a blowing side. The motor for driving the hub and the fan blades is located in the region of the axis of rotation of the hub. Such a venting device is, for example, known from DE 297 23 738 U1. If, in the event of a fire, such fans are to be used to draw off hot air from the fire source, on the one hand, there is a problem in that hot air passing by the motor will heat the motor. On the other hand, there is the problem that for these purposes, such a fan is unwieldy because in many cases it cannot be advanced sufficiently near or sufficiently target-oriented to the place at which to draw off, as for example a cellar or dwelling-room window. If a suction hose is used here, the latter exhibits a diameter of more than 1 meter with such large fans, so that it can hardly be passed through cellar windows or the like. Besides, in doing so, a reversion of the direction of rotation of the fan blades is used for the most part, whereby the problem arises that the produced airstream becomes turbulent and not laminar as without reversion of the direction of rotation. Thereby an unwanted "fogging" of the fan is caused, so that the fire fighter operating the fan is exposed to substantial dangers, in particular when drawing off hazardous conflagration gases, like plastic residues in cable fires.

The invention is based on the problem to create an improved device for venting a cavity like a cellar or a dwelling-room, which device will overcome the aforementioned disadvantages and is handy to operate as well as extremely versatile. This problem is solved with a device for venting a cavity according to claim 1. Advantageous developments of the invention are the subject-matter of the dependent claims.

According to the invention, there is provided a cover arrangement that can be attached on the suction side, whereby a part of the suction side is covered. This cover arrangement has at least one opening, to which a relatively slim suction hose can be connected. The free end of the suction hose can then simply be run to the place to be exhausted, as for example a fire source in a cellar. Thus, the device according to the invention most precisely exhausts a desired target place. In addition, the drawn-off hot air is not passed over the motor of the fan to heat it; rather, the motor is intensely cooled by the passing air which is sucked across the surface of the suction side not covered by the cover arrangement and into the venting device.

A particularly good compromise between suction power and sufficient cooling of the motor is obtained, if the cover arrangement covers 20 to 80%, and preferably about 40 to 60%, of the surface of the suction side.

The operation of the device according to the invention is substantially facilitated by the suction hoses of relative small diameters. Besides, the cover arrangement can be attached to the fan housing in a simple way by means of a snap closure or be hinged to the fan housing by means of a hinge. The handling is further improved, if each suction hose is fixed to the cover arrangement by means of a snap closure. Transport and storage of the device according to the invention can be simplified, if the fan housing is formed as a winding drum for the suction hose or suction hoses.

The handling of the cover arrangement becomes more customizable, if the latter is subdivided into at least two cover parts, to which a suction hose each can be connected via an associated opening. In doing so, the motor will be cooled exceptionally good, if the cover parts each are affixed in a same angular distance from each other.

Affixing the cover parts and connecting the suction hoses thereto is then particularly simple to manage, if two cover parts are provided, which are respectively arranged laterally oh both sides of the motor, i.e., horizontally opposing each other. A particularly high suction power and simultaneous good cooling of the motor can be achieved, if three cover parts are arranged at a pitch of 120° (and free ring segments lying inbetween) from each other. In order to maximally simplify the assembly of the cover parts and the connection of the suction hoses to the fans which exhibit a diameter of approximately 1.25 m and in many cases are additionally supported on a base frame or a carriage, one of the cover parts with its associated suction hose can be arranged at the bottom and the other two cover parts can be arranged horizontally opposed to each other further above.

It is preferred to design the cover parts as ring-like segments, wherein the outer contour of these segments is defined by the fan housing of the axial-flow fan and the interior limitation of these segments is defined by the casing of the motor which does not necessarily have to be cylindrical and thus slightly modifies the ring form of the segment.

Figure 2:
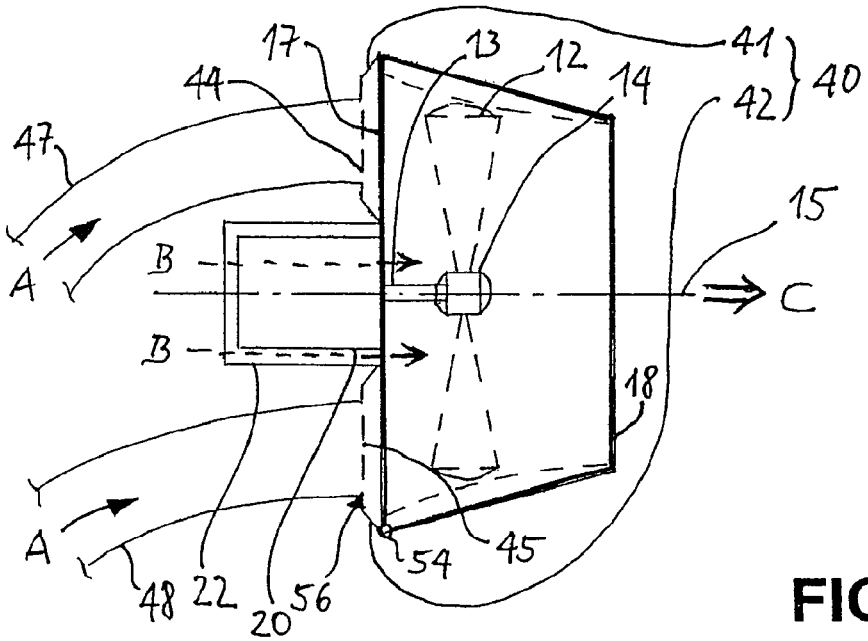

Further advantages, features and characteristics of the invention will be seen from the following description of preferred, however not limiting embodiments of the invention on the basis of the drawing, though schematic and not true to scale, wherein:

FIG. 1 is a first embodiment of the venting device according to the invention, seen from the suction side, and FIG. 2 is a plan view of a second embodiment of the venting device according to the invention.

FIG. 1 shows a first embodiment of the venting device 10 according to the invention, having the cover arrangement 30 divided into three cover parts (also called scoops) 31 to 33. The cover parts 31 to 33 are respectively formed as ring segments with an angle overlap of 90°, thus covering about three quarters of the suction side. The three cover parts 31 to 33 each have an angular distance of 120° to each other and are fixed by means of snap closures 52 here only implied—e.g. in the form of rest catches. The merely schematically indicated fan blades 12 are only partly covered by the cover parts 31 to 33, and also the hub 14 bearing the fan blades 12 as well as the motor 20 arranged in a casing 22 are likewise represented only schematically, since these components correspond to a standard axial-flow fan. In the cover parts 31 to 33 there are now provided openings 34, 35 and 36, respectively, through which respective suction hoses 37, 38 and 39, respectively, may be connected by means of snap closures 36 likewise represented only schematically (for example rest, screw, or bayonet catches).

The venting device 10 illustrated in FIG. 1 is designed as an axial-flow fan which is illustrated as seen from its suction side 17, wherein the direction of motion of the air drawn in by the suction hoses 37 to 39 off the desired place to be exhausted is respectively indicated by an arrow A. Besides, also ambient air at the places of the suction side 17, not covered by the cover parts 31 to 33, is additionally drawn off into the venting device 10 according to the arrows B, thus cooling the driving motor 20, and is afterwards blown out again at the blowing side 18 (cf. FIG. 2).

FIG. 2 shows a plan view of a second advantageous embodiment of the venting device 10 according to the invention. In a casing 22 a motor 20 is mounted, which drives a hub 14 via a driving shaft 13, to which hub the fan blades 12 are fixed. These fan blades 12 are surrounded by a funnel-shaped fan housing 16 which is here illustrated conically to simplify matters. Thereby, the motor 20 is arranged on the suction side 17. In this embodiment, the cover arrangement 40 is divided in two cover parts 41 and 42 only, arranged with an angular distance of 180° from each other (in the drawing plane top and bottom, respectively, which corresponds to a lateral arrangement on the left and on the right of the motor 20). Cover part 41 has an opening 44, and cover part 42 has an opening 45. Via the openings 44, 45 suction hoses 47 and 48, respectively, can be coupled to the cover parts 41 and 42, respectively, whereby again fire air can be sucked in, which is indicated by respective arrows A. Additionally, above and underneath the motor 20 fresh air is sucked into the fan at the regions not covered by the cover parts 41, 42, which is indicated by broken arrows B. According to a double arrow C, the sucked-in fresh air and fire air are blown out together on the blowing side 18 in a directed laminar discharge. The cover parts 41 and 42 are hinged on the fan housing 16 by means of hinges 54 illustrated only schematically.

From FIG. 2 it is evident that the funnel-shaped fan housing 16 can also be used to wind up the relatively slim suction hoses 47 and 48, if these are separated by disengaging the snap closures 56, illustrated only schematically, from the cover parts 41 and 42, respectively.

Assuming those two cover parts 41 and 42 to be also designed as ring segments and to cover each an angle region of 80°, a covering of about one third of the suction side 17 is thus achieved. Dependent on the respective conditions as, for example, the temperature to be expected of the sucked-in "fire air" and the heat development of the motor 20 in continuous or only short-time operation, a covering of one third to two thirds, preferably about half of the suction side 17, should be optimal.

According to the invention, the venting device 10 can be arranged relatively far away from the place to be vented (which in the event of fire is possibly very hot), whereby the suction power in the desired place is not affected, because the suction hoses coupled to the cover means effect the suction very precisely and efficiently. Thus, the venting device 10 according to the invention is very versatile, since the suction hoses can also be readily inserted into manholes or cellar shafts or through the windows or doors of a dwelling-room, the lengths of the hoses being additionally variable by linking several tubes.

It is to be noted that the features of the invention, described with reference to individual embodiments, as for example the design of the cover arrangement (scoop form or in collar form) or its fixing at the fan housing, can be present with other embodiments, too.

The invention claimed is:

1. A device for venting a cavity, in particular a cellar or a dwelling-room, comprising:

fan blades which are fixed to a hub and surrounded by a fan housing provided with a suction side having a suction opening and a blowing side;

a motor located in the region of the axis of rotation of the hub for driving the hub and the fan blades; and, a suction side cover arrangement comprising at least two cover plates formed as truncated wedge-shaped ring segments having a space between adjacent cover plates, the cover plates having a suction hose connectable via an associated opening, wherein the motor is arranged in a casing defining an inner boundary of the ring segments, and wherein the motor is capable of being cooled by air drawn through the spaces between the cover plates.

2. A device according to claim 1, wherein the cover arrangement covers 20 to 80% of the surface on the suction side.

3. A device according to claim 1, wherein the cover arrangement is affixed to the fan housing with a snap closure.

4. A device according to claim 1, wherein the cover arrangement is hinged to the fan housing.

5. A device according to claim 1, wherein each suction hose is affixed to the cover arrangement with a snap closure.

6. A device according to claim 1, wherein the cover plates are affixed in a same pitch angle distance from each other.

7. A device according to claim 1, wherein the cover arrangement comprises two cover plates laterally affixed horizontally opposed to each other.

8. A device according to claim 1, wherein the cover arrangement comprises three cover plates, one cover plate affixed at a bottom portion on the suction side and the two other cover plates laterally affixed horizontally opposed to each other.

9. A device according to claim 1, wherein the fan blades in the fan housing are formed as an axial-flow fan.

* * * * *